US010478963B1

(12) United States Patent
Workman

(10) Patent No.: US 10,478,963 B1
(45) Date of Patent: Nov. 19, 2019

(54) MODULAR STORAGE CONTAINER

(71) Applicant: Jeanne Workman, Provo, UT (US)

(72) Inventor: Jeanne Workman, Provo, UT (US)

( * ) Notice: Subject to any disclaimer, the term of this patent is extended or adjusted under 35 U.S.C. 154(b) by 0 days.

(21) Appl. No.: 16/001,847

(22) Filed: Jun. 6, 2018

(51) Int. Cl.

| | |
|---|---|
| ***A45C 13/02*** | (2006.01) |
| ***B25H 3/02*** | (2006.01) |
| *B25B 15/00* | (2006.01) |
| *B26B 3/04* | (2006.01) |
| *B26B 1/10* | (2006.01) |
| *B25F 1/00* | (2006.01) |

(52) U.S. Cl.
CPC ..... *B25H 3/023* (2013.01); *A45C 13/02* (2013.01); *B25B 15/001* (2013.01); *B25F 1/00* (2013.01); *B26B 1/10* (2013.01); *B26B 3/04* (2013.01)

(58) Field of Classification Search
CPC ..... B25B 15/00; B25B 15/001; B25F 1/00; B25H 3/02; B25H 3/023; B26B 1/10; B26B 3/04; A45C 13/02
USPC ..... 206/349–378; 220/529–552
See application file for complete search history.

(56) References Cited

U.S. PATENT DOCUMENTS

| | | | | |
|---|---|---|---|---|
| 1,862,057 | A * | 6/1932 | Lewis | A47G 19/24 220/532 |
| 3,958,715 | A * | 5/1976 | Capelli | B65D 25/00 220/532 |
| 4,911,295 | A | 3/1990 | Venegoni | |
| 5,103,998 | A * | 4/1992 | Caro | B65D 25/06 220/531 |
| 5,484,078 | A * | 1/1996 | Bronovicki | B65D 25/04 220/528 |
| 5,540,329 | A | 7/1996 | Vogeley | |
| 5,806,708 | A * | 9/1998 | Schwab | A45C 11/008 220/378 |
| 5,833,052 | A * | 11/1998 | Diamond | A45C 11/16 220/533 |
| 6,047,842 | A | 4/2000 | Feidt | |
| 7,784,145 | B1 * | 8/2010 | Prokop | B44D 3/126 220/702 |
| 7,984,820 | B2 | 7/2011 | Dancyger | |
| 7,992,250 | B2 * | 8/2011 | Prokop | B44D 3/126 220/529 |
| 8,893,915 | B2 | 11/2014 | Vargas | |
| D782,233 | S | 3/2017 | Jackson | |
| D784,746 | S | 4/2017 | Jackson | |
| 9,682,471 | B2 * | 6/2017 | Jacobson | B25H 3/00 |
| 2003/0085142 | A1 * | 5/2003 | Ouimette | B25H 3/00 206/373 |
| 2008/0128428 | A1 | 6/2008 | Beckerman | |
| 2001/0084040 | | 4/2011 | Curtin | |

* cited by examiner

*Primary Examiner* — Bryon P Gehman
(74) *Attorney, Agent, or Firm* — David R. Conklin; Kirton McConkie

(57) ABSTRACT

A storage container having a base storage compartment configured to receive a divider by which the storage compartment is divided into two or more sub-compartments, wherein the divider includes a tool configured to provide a secondary utility or function unrelated to dividing the storage compartment.

14 Claims, 17 Drawing Sheets

MODULAR STORAGE CONTAINER

FIELD OF THE INVENTION

This invention generally relates to portable containers for storing various items according to the specific needs and desires of a user. Specifically, the present invention relates to a storage container having a base storage compartment configured to receive one or more dividers by which the storage compartment is divided into two or more sub-compartments, wherein at least one of the dividers further includes a tool configured to provide a secondary utility.

BACKGROUND OF THE INVENTION

Many service and trade professions involve tools or other objects which are required in order for the worker to quickly and efficiently perform their service. For example, both mechanics and surgeons utilize a variety of tools and materials that must be organized and readily accessible during the performance of a task. Similarly, housekeepers and tradesman (i.e., plumbers, electricians, carpenters, repair technicians, handymen, etc.) utilize a wide variety of tools, parts, chemicals, etc. that are highly specialized to the specific task at hand. In addition to professional occupations, many crafts and hobbies involve the use of tools, chemicals, adhesives, and a variety of small parts which are easily misplaced or obscured by other equipment.

When a user is required to search for items while performing a task, the efficiency of the user decreases and frustration often occurs. In some instances, a user's inability to quickly and efficiently locate a needed item can result in increased consumer costs, repurchase of "lost" items, or in the case of a surgeon, added patient injury and/or death.

There currently exist a variety of storage-specific containers or other containers that are commonly used or retrofitted to meet the storage needs of a user. For example, a standard five-gallon bucket is commonly used by tradesmen to hold their various tools, parts and materials for use on a jobsite. In some instances, all of the user's materials are simply placed into the bucket in a random manner, whereby the user is required to dig and sort through the contents of the bucket to find their desired items. Various storage or organizing systems are available for five-gallon buckets, some of which include internal dividers, stackable organizing trays, and/or internal/external storage pockets which hang from the rim of the bucket. Alternative storage containers include a variety of caddies, totes, trays, carts and other types of storage containers having a variety of compartments having shapes and sizes that are generally designed to receive one or more common items. For example, a caddy advertised and sold for use with cleaning tools, may include a compartment having dimensions for receiving a standard spray bottle. For hobbies and crafts, or other instances where storage of small items is desired, a variety of storage systems are available which include movable dividers which may be strategically placed by the user to achieve a desired sub-compartment layout. Generally, these dividers are placed between sidewalls of the container and/or between one or more immovable interior wall or divider. Thus, the user may be limited in one or more desired dimension of a desired sub-compartment.

Thus, while systems and methods currently exist for organizing and providing ready access to a variety of tools, items and materials, challenges still exist. The present invention addresses and overcomes these challenges.

BRIEF SUMMARY OF THE INVENTION

The present disclosure relates generally to a portable, modular storage container for storing various items according to the specific needs and desires of a user. In some instances, the storage container includes a planar base that is generally rectangular and includes sidewalls extending about or surrounding a perimeter of the planar base, wherein an upper perimeter edge of the sidewalls defines an opening of the storage container. In some instances, the planar base and sidewalls define an interior volume of the storage container.

In some instances, the upper perimeter edge of the sidewalls further includes a rim. In some instances, the rim reinforces the sidewalls. In some instances, the rim further includes one or more internal channels or pathways forming a storage compartment within a portion of the rim. In some instances, the sidewalls further comprise an inner surface having two or more receptacles which are arranged opposite one another and configured to compatibly and selectively receive a divider. In some instances, the two or more receptacles comprise a channel or recessed surface of the inner surface of the sidewall. In some instances, the two or more receptacles comprise a ridge, rail or extension of the inner surface of the sidewall.

In some instances, the storage container further includes a handle. In some instances, the handle is coupled to at least one of the planar base, the sidewalls, and the rim. In some instances, the handle divides the interior volume into two or more sub-compartments, wherein a portion of the handle that is located within the interior volume comprises one or more receptacles. In some instances, a portion of the handle extends outwardly from the interior volume and is positioned above the upper perimeter edge and/or rim portions of the container.

The present invention further comprises a divider configured to selectively couple to the inner surface of the sidewall via the two or more receptacles. In some instances, a divider includes first and second side edges that are configured to selectively coupled to the two or more receptacles. In some instances, a divider further includes a bottom edge configured to contact an inner surface of the planar base. In some instances, a bottom edge of the divider is suspended above an inner surface of the planar base when first and second edges of the divider are fully engaged with the two or more receptacles. In some instances, the divider further comprises a top edge positioned opposite the bottom edge, wherein the divider further comprises a body defined by the top, bottom, first side, and second side edges.

In some instances, the top edge of the divider comprises a rim or lip that extends outwardly from the body and is configured to contact and rest on a portion of the upper perimeter edge and/or rim of the storage container when first and second side edges are engaged with the two or more receptacles.

In some instances, the tool portion of the divider comprises a first tool wall positioned at 90 degrees from a second tool wall, wherein first and second tool walls further comprise one or more edges, splines, ridges, channels or other compatible feature or surface for selectively engaging the one or more receptacles of the storage container. In some instances, a tool wall of the divider comprises one or more edges configured to selectively one or more receptacles of the storage container. In some instances, a first set of edges of the first tool wall is configured to selectively engage a first set of receptacles on a first sidewall of the storage container, and a second set of edges of the second tool wall is configured to selectively engage a second set of receptacles on a third sidewall of the storage container, wherein the third sidewall is 90 degrees to the first sidewall. In some instances, the second set of receptacles is provided on a divider of the present invention. In some instances, the tool comprises a third tool wall positioned opposite the first tool wall, and a fourth tool wall positioned opposite the second tool wall, wherein the third tool wall and fourth tool wall comprise a third set of edges, and a fourth set of edges, respectively. In some instances, the third set of edges is configured to selectively engage a third set of receptacles provided on a second sidewall of the storage container, and the fourth set of edges is configured to selectively engage a fourth set of receptacles on a fourth sidewall, wherein the second and fourth sidewalls are parallel to one another and 90 degrees to first and third sidewalls of the storage container. In some instances, any one of the first, second, third, and fourth sidewalls of the storage container may comprise a divider of the present invention. In some instances, a body or other surface of any one of the first, second, third, and fourth sidewalls may comprise one or more receptacles configured to receive one or more edges or other compatible surfaces or features of a divider, tool, or tool wall of the present invention. Thus, first, second, third, and fourth sidewalls may be substituted with first, second, third, and/or fourth dividers, in any desired combination.

In some instances, the tool portion further comprises a concave or convex surface. In some instances, the tool portion comprises a radius. In some instances, the tool portion of the divider comprises one or more receptacles. In some instances, a cross-section of the body is at least one of a square, a rectangle, a triangle, a circle, and an annulus.

Various dividers of the present invention further comprise one or more tools integrated into one or more surfaces of the divider. For example, in some instances a bottom edge of the divider includes a tapered surface comprising a scraper. In some instances, the tapered surface comprises a knife edge. In some instances, a bottom edge of the divider comprises a plurality of tines. In some instances, a bottom edge of the divider comprises an abrasive scrubbing material. In some instances, the body portion of the divider comprises a screwdriver tip.

In some instances, the divider comprises a single material. In some instances, the divider comprises two or more materials, wherein one or more additional materials are selected to provide a desired property or mechanical advantage for the tool portion of the divider. For example, in some instances the bottom edge comprises a metal material that may be sharpened to provide a knife edge, or that may be provided simply as a scraping surface (such as for use in removing adhesive labels or other residue from glass or tile surfaces). In another example, the bottom edge comprises an abrasive scrubbing material, such as coiled stainless steel, steel wool, or a plastic mesh (such as a Scotch-Brite® pad).

In some instances, a tool portion of a divider comprises a plurality of tool sides or walls forming a container or compartment, wherein an outer surface of each tool wall is configured to compatibly and selectively engage a receptacle of the storage container. In some instances, the tool portion of the divider is a storage compartment. In some instances, the tool portion of the divider comprises a plurality of storage compartments. In some instances, the tool portion of the divider is watertight, such as a rinse cup or container. In some instances, the tool portion of the divider comprises a hemispherical concave recess configured to compatibly receive and store a brush end of a toilet brush, wherein the concave recess comprises one or more drainage holes.

The present invention further includes one or more external storage containers, compartments, or tools configured to compatibly and selectively couple to an outer surface of one or more sidewalls of the storage container. In some instances, the one or more external storage containers, compartments or tools is configured to compatibly and selectively couple to the rim of the storage container. In some instances, the one or more external storage container, compartments or tools is configured to compatibly and selectively couple to the storage container via an adapter, such as a hook, a receptacle, a slot, a keyed interface, or the like. In some instances, an exterior surface of the storage container comprises one or more receptacles configured to compatibly and selectively receive one or more edges or other features of a divider, tool, or tool wall of the present invention. In some instances, an external storage container or compartment comprises a cup holder. In some instances, an external storage container or compartment comprises a cellphone holder. In some instances, an external tool comprises a wireless speaker. In some instances, an external tool comprises a retractable cord for holding keys or an identification badge. In some instances, an external tool comprises one or more hooks or other features configured to secure a tool, a part, a material, or other desired item. In some instances, a surface of the storage container comprises a tool that is embedded therein or applied thereon, for example a surface of the storage container may include a sidewall, a rim, or a handle.

It is to be understood that both the foregoing general description and the following detailed description are exemplary and explanatory and are not restrictive of the invention, as claimed.

BRIEF DESCRIPTION OF THE SEVERAL VIEWS OF THE DRAWINGS

Example embodiments will be described and explained with additional specificity and detail through the use of the accompanying drawings in which.

DETAILED DESCRIPTION OF THE INVENTION

The presently preferred embodiments of the present invention will be best understood by reference to the drawings, wherein like reference numbers indicate identical or functionally similar elements. It will be readily understood that the components of the present invention, as generally described and illustrated in the figures herein, could be arranged and designed in a wide variety of different configurations. Thus, the following more detailed description, as represented in the figures, is not intended to limit the scope of the invention as claimed, but is merely representative of presently preferred embodiments of the invention.

Figure 1:
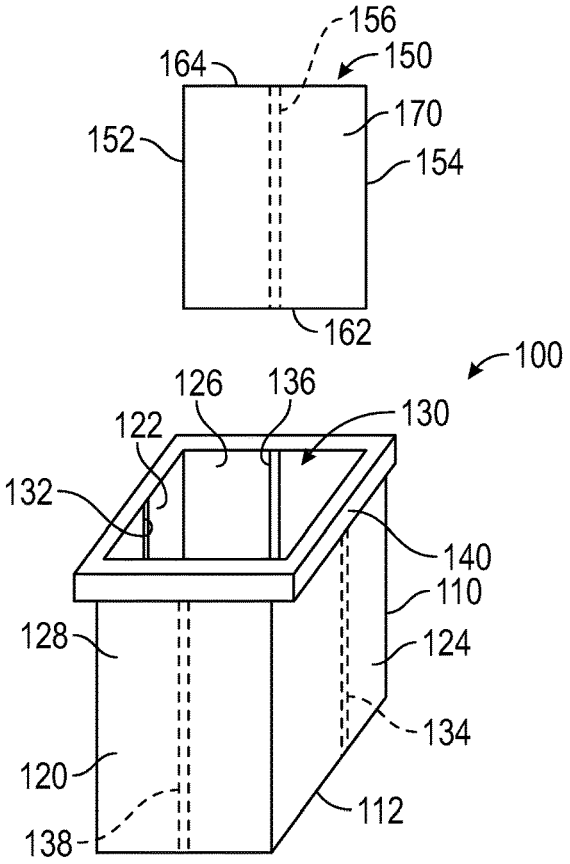
FIG. 1 is an exploded perspective view of a storage container and divider in accordance with a representative embodiment of the present invention.

Referring now to FIG. 1, a storage system 100 is shown. In some embodiments, a storage system 100 of the present invention comprises a storage container 110 generally comprising an interior volume 130 configured to receive and store one or more items. Storage container 110 may comprise any geometric shape or shapes. For example, in some embodiments storage container 110 comprises a rectangular box shape. Alternatively, storage container 110 may comprise a round, oval, triangular or other polygonal shape. Storage container 110 generally comprises a planar base 112 having an outer perimeter edge defining a shape, wherein the shape of planar base 112 defines an overall shape of the container.

Storage container 110 further comprises a plurality of sidewalls 120 coupled to the outer perimeter edge and enclosing planar base 112. Sidewalls 120 comprise a lower perimeter edge that is coupled to planar base 110, and further comprise an upper perimeter edge that is separated from the lower perimeter edge by a sidewall height. The height of sidewalls 120 defines a depth of storage container 110 and interior volume 130. In some embodiments, sidewalls 120 provide a continuous exterior wall surface for storage container 110. Sidewalls 120 further provide a continuous interior wall surface. In some embodiments, sidewalls 120 provides a first sidewall 122 positioned opposite a second sidewall 124, wherein first and second sidewalls 122 and 124 define a length of storage container 110. Sidewalls 120 further comprise a third sidewall 126 and fourth sidewall 128 positioned opposite third sidewall 126, wherein third and fourth sidewalls 126 and 128 define a width of storage container 110. In some embodiments, first, second, third and fourth sidewalls 122, 124, 126, 128 define interior volume 130.

The interior sidewall surfaces of storage container 110 further comprise one or more receptacles 132, 134, 136 and 138. Receptacles 132, 134, 136 and 138 may comprise any surface, feature or design compatible with the various embodiments of the present invention. For example, a suitable receptacle of the present invention may comprise a groove, a channel, a recess, a ridge, a spline, a rail, a dovetail slide, or other keyed or non-keyed interface surface. In some embodiments, first sidewall 122 comprises a first receptacle vertically disposed between the upper and lower perimeter edges of first sidewall 122. In some embodiments, at least one of second, third, and fourth sidewalls 124, 126 and 128 further comprise second, third, and fourth receptacles 134, 136 and 138, respectively. In some embodiments, each sidewall surface comprise a plurality of receptacles.

In some embodiments, storage container 110 further comprises a rim 140 coupled to and circumscribing the upper perimeter edge of sidewalls 120. Rim 140 generally provides a thicker or wider profile or shape to the upper perimeter edge and further reinforces sidewalls 120. In some embodiments, rim 140 comprises one or more channels or pathways forming a storage compartment, as discussed in detail below.

Storage system 100 further comprises a divider 150. Divider 150 is generally coupled to two or more receptacles of storage container 110 in order to divide the interior volume 130 into two or more spaces or sub-compartments. In some embodiments, divider 150 comprises the same material as storage container 110. In some embodiments, divider 150 comprises two or more materials having desired properties within the scope of the present invention. In some embodiments, divider 150 is generally planar having a rectangular shape with a width and height configured to divide interior volume 130 into two or more sub-compartments. In addition to dividing interior volume 130, divider 150 further comprises one or more tools configured to provide an auxiliary function, wherein the auxiliary function is beneficial to the user or an intended use or function for which the storage container 110 is intended.

In some embodiments, divider 150 comprises a first edge 152 configured to selectively coupled to first receptacle 132, and further comprises a second edge 154 configured to selectively couple to second receptacle 134. Divider 150 comprises a bottom edge 162 configured to contact an inner surface of planar base 112 when first and second edges 152, 154 are selected engaged with first and second receptacles 132, 134. Divider 150 further comprises a top edge 164 positioned opposite bottom edge 162 and generally positioned in proximity to upper perimeter edge and/or rim 140 when engaged with, or coupled to receptacles 132, 134.

Divider 150 further comprises a body 170 defining a surface between first, second, bottom and top edges 152, 154, 162, 164. In some embodiments, body 170 is generally planar. In some embodiments, body 170 comprises a three-dimensional shape. In some embodiments, body 150 comprises one or more receptacles 156.

Divider 150 further comprises a tool or tool surface, wherein the tool provides an auxiliary function or benefit to the user. For example, divider 150 provides a primary or first function of engaging receptacles 132 and 134 to divide interior volume 130 into two sub-compartments, and further comprises a tool that provides an auxiliary or second function separate and apart from the first function. Thus, divider 150 provides two or more functions, wherein at least one of the functions is to divide interior volume 130.

Figure 2A:
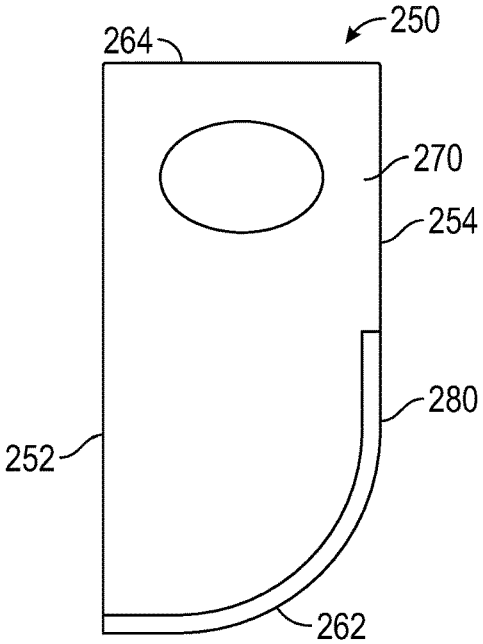
FIGS. 2A-2F provide front and side plan views of various dividers having tools in accordance with various representative embodiments of the present invention
Figure 2B:
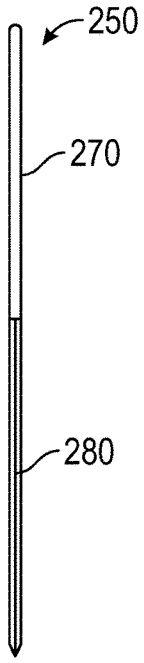

Referring now to FIGS. 2A and 2B, a divider 250 is shown having an integrated tool or tool surface 280 comprising a scraper. Divider 250 generally comprises a planar body 270. A lower portion of second edge 254 and the entire bottom edge 262 is beveled or tapered to provide a sharpened tip or edge that may be used as a scraper. In some embodiments, bottom edge 262 is asymmetrical, wherein an intersection between bottom edge 262 and first side 252 is a right angle, and an intersection between bottom edge 262 and second edge 254 is a radius. In some embodiments, divider 250 and tool or tool surface 280 comprise an identical material, such as a polymer. In some embodiments, divider 250 comprises a polymer material and tool 280 comprises a metal material. In some embodiments, divider 250 and tool 280 comprise a metal material. In some embodiments, tool 280 comprises a metal material that may be sharpened to provide a knife edge. In some embodiments, tool 280 is disposable and/or replaceable. In some embodiments, tool 280 is located entirely on bottom edge 262, wherein bottom edge 262 is straight or contoured. In some embodiments, tool 280 comprises a single bevel. In some embodiments, tool 280 comprises a double bevel. In some embodiments, tool 280 comprises a double bevel having a first side comprising a first bevel angle and a second side comprising a second bevel angle that is greater than the first bevel angle.

Figure 2C:
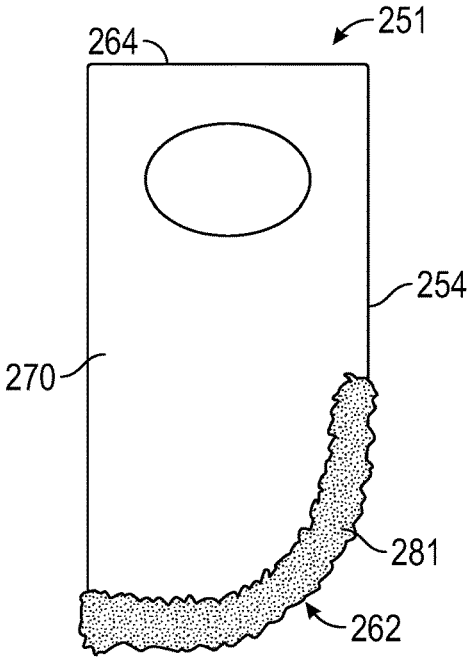
Figure 2D:
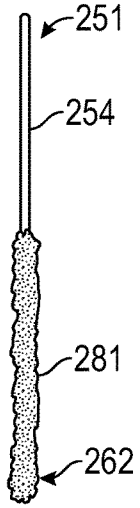

Referring now to FIGS. 2C and 2D, a divider 251 is shown having an integrated tool 281 comprising a scrubbing pad or material. In some embodiments, a lower portion of second edge 254 and the entire bottom edge 262 comprises an abrasive scrubbing material, such as coiled stainless steel, steel wool, pumice, sandpaper, or a plastic mesh material, such as a Scotch-Brite® pad. In some embodiments, the abrasive scrubbing material of tool 281 is coupled to second and bottom edges via an adhesive. In some embodiments, the abrasive material is integrated, incorporated, or infused into the material of divider 251. In some embodiments, divider 251 is comprised of an abrasive material.

Figure 2E:
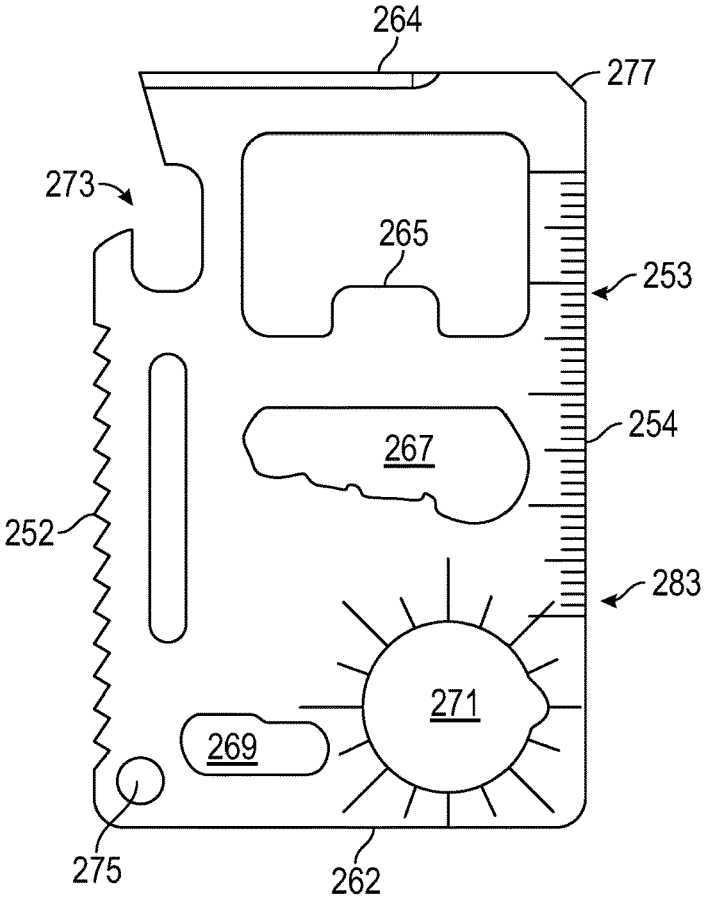
Figure 2F:
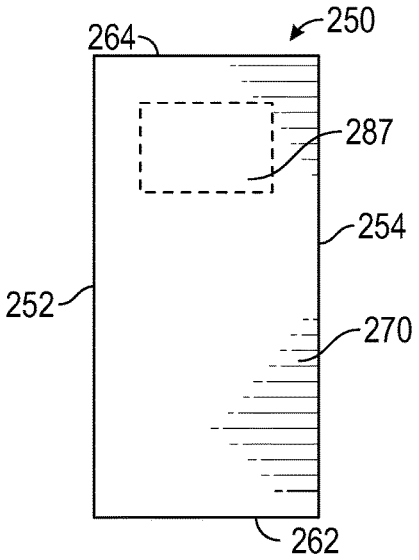

Referring now to FIG. 2E, a divider 253 is shown having a plurality of tools, wherein divider 253 is a multi-tool 283. In some embodiments, divider 253 comprises two or more tools that provide additional benefits to the storage system. For example, in some embodiments an edge surface, such as first edge 252, comprises a saw edge. In some embodiments, an edge surface, such as second edge 254, comprises a ruler. In some embodiments, an edge surface, such as top edge 264, comprises a blade or knife edge. In some embodiments, tool 283 further comprises one or more of a bottle opener 265, a four-position wrench 267, a two-position wrench 269, and a direction indicator 271. In some embodiments, one or more corners of divider 253 further comprises a tool, such as a can opener 273, a keyring hole 275 and/or a screwdriver tip 277. One having skill in the art will readily recognize and understand that divider 253 can be modified to include any number and variety of tools configured to provide one or more additional benefits to storage system 100.

In some embodiments, a divider of the present invention comprises a tool 287 that is embedded within body 270, or applied to an outer surface of body 270, as shown in FIG. 2E. In some embodiments, tool 287 comprises a magnet. In some embodiments, tool 287 comprises an RFID chip, such as part of a security access card or identification badge. In some embodiments, tool 287 comprises a mirror. In some embodiments, tool 287 comprises an adhesive memo pad. In some embodiments, tool 287 comprises a power source, such as a portable charger. In some embodiments, tool 287 comprises a thumb drive. In some embodiments, tool 287 comprises a hook and/or loop fastener material. In some embodiments, tool 287 comprises a magnifying glass. In some embodiments, tool 287 comprises a bubble level. In some embodiments, tool 287 comprises a carpenter square. In some embodiments, tool 287 comprises a joint knife, a putty knife, a plaster knife, a mud knife, a taping knife, a spackle knife, or the like. In some embodiments, tool 287 comprises a chisel or chisel edge. In some embodiments, tool 287 comprises a wire brush or a plurality of wire bristles. In some embodiments, tool 287 comprises a length of adhesive tape, such as masking tape, duct tape, pressure-sensitive tape, double-sided tape, electrical tape, and the like. In some embodiments, tool 287 comprises a mount configured to hold a roll of adhesive tape. In some embodiments, tool 287 comprises a mount configured to hold a roll of solder. In some embodiments, tool 287 comprises a mount configured to hold and store an electrical cord, such as an extension cord, a lamp cord, a power cord of an appliance or a consumer product that is stored within, or used in combination with storage container 110.

Figure 2G:
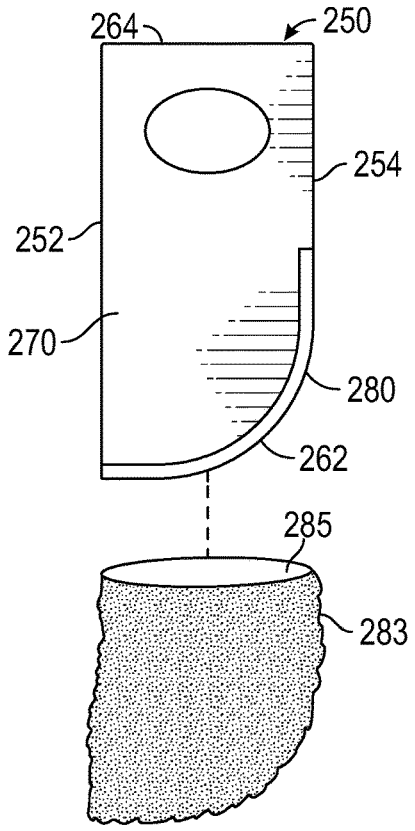
FIG. 2G is an exploded perspective view of a divider and auxiliary tool in accordance with a representative embodiment of the present invention.

Some embodiments of the present invention further comprise an auxiliary tool 283 configured to connect with or otherwise engage divider 250 to provide an additional benefit or function to tool 280, divider 250, and storage system 100. For example, in some embodiments storage system 100 further comprises an auxiliary tool 283 comprising a cover, sleeve, or cozy having an opening 285 configured to receive bottom edge 262, a portion of body 270, and one or more additional surfaces of divider 250, as shown in FIG. 2G. In some embodiments, auxiliary tool 283 comprises an abrasive scrubbing or scouring material. In some embodiments, auxiliary tool 283 comprises a squeegee surface. In some embodiments, auxiliary tool 283 comprises a sponge. In some embodiments, auxiliary tool 283 comprises a cleaning solution or material, such as soap, bleach, ammonia, or an antibacterial agent.

Figure 3:
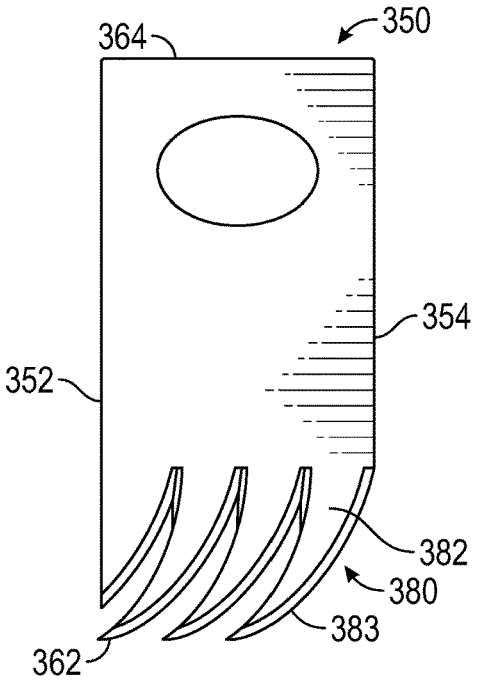
FIG. 3 is a front plan view of a divider having a tool in accordance with a representative embodiment of the present invention.

Referring now to FIG. 3, a divider 350 is shown having an integrated tool 380 comprising a plurality of tines 382 forming a comb. The plurality of tines 382 are formed from portions of first and second edges 352 and 354, and the entirety of bottom edge 362. In some embodiments, tool 380 comprises one or more features for use as a tool to remove hair, string, carpet fibers and other debris from the brushroll of a vacuum. For example, in some embodiments tines 382 are curved or arched to provide a hook-shape or contour to the comb. Tines 382 may further comprise beveled edges 383. In some instances, beveled edges 383 are sharpened. In some instances, tool 380 comprises a metal material, whereby beveled edges 383 are sharpened to a knife edge. Tines 382 may further comprise sharpened tips configured to assist a user in loosening tightly wound debris.

Figure 4A:
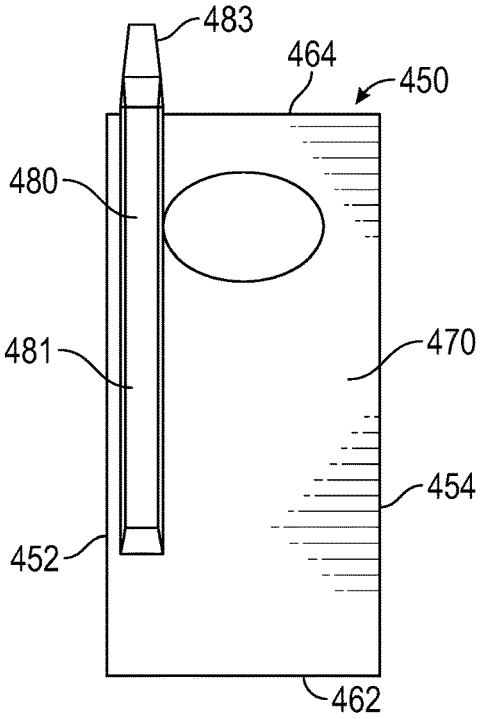
FIGS. 4A-5D provide front and side plan views of various dividers having tools in accordance with various representative embodiments of the present invention.
Figure 4B:
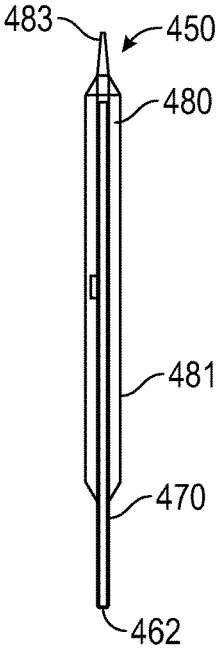
Figure 5A:
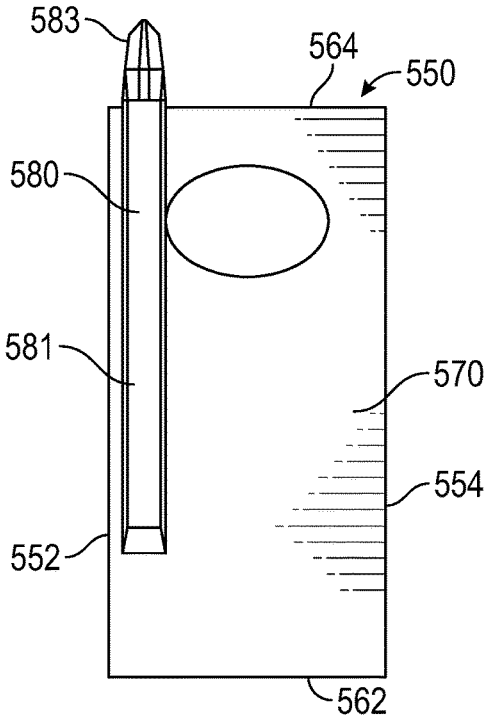
Figure 5B:
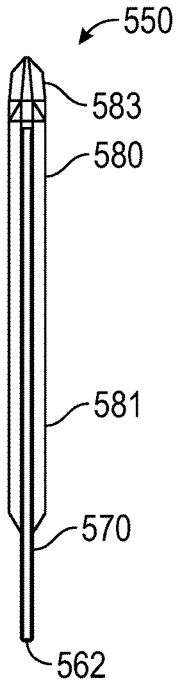

Referring now to FIGS. 4A and 4B, divider 450 is shown having an integrated tool 480 comprising a flathead screwdriver. In some embodiments, a portion of body 470 comprises a flathead screwdriver. In some embodiments, one or more edge surfaces comprises a flathead screwdriver. Flathead screwdriver 480 generally includes a handle or shaft portion 481 comprising a thickened portion of divider 450, such as a thickened portion of body 470. In some embodiments, flathead screwdriver 480 further comprises a flathead tip 483 that is connected to shaft 481 and extends outwardly from top edge 464, such that body 470 and the remaining surfaces of divider 450 do not obstruct use of tip 483. A similar divider 550 is provided having an integrated tool 580 comprising a phillips head screwdriver 580, as shown in FIGS. 5A and 5B.

Figure 5C:
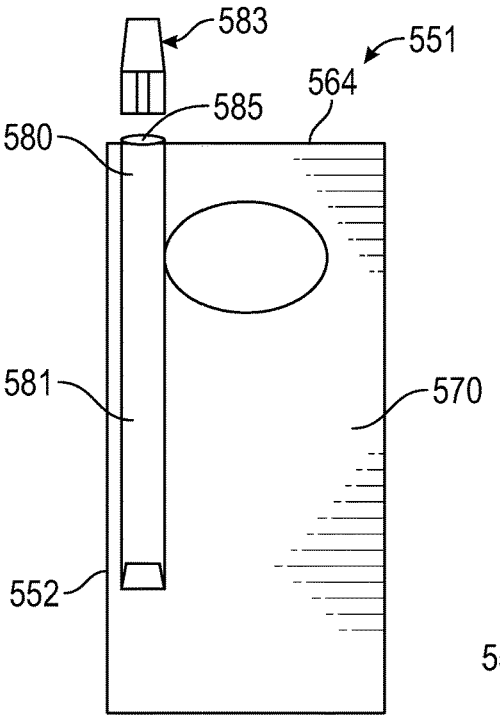
Figure 5D:
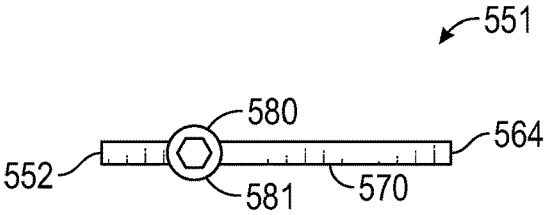
Figure 6A:
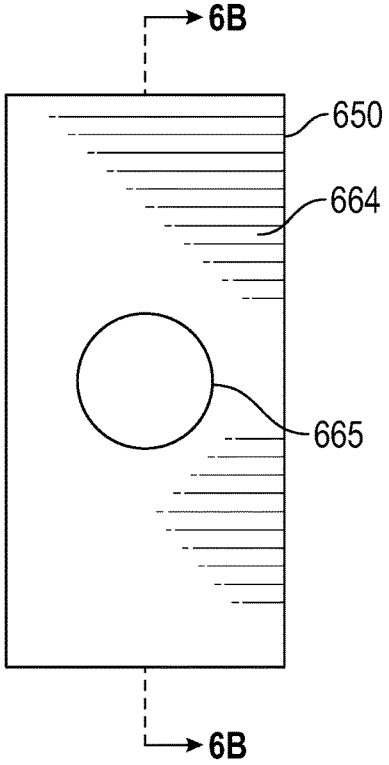
FIGS. 6A-6D provide a cross-section side view, and top, end, and bottom plan views of a divider comprising a top surface having a round opening in accordance with a representative embodiment of the present invention.
Figure 6B:
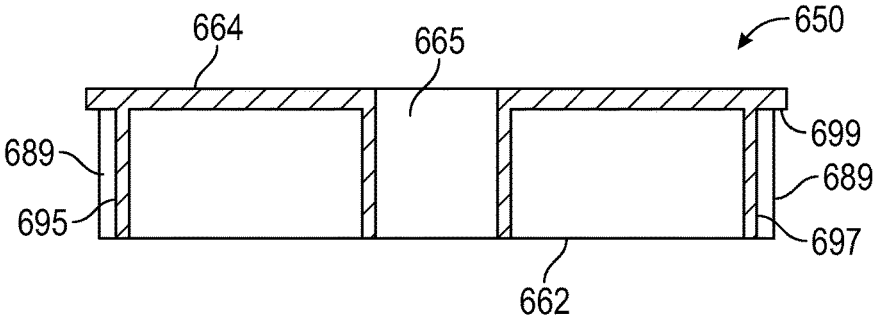
Figure 6C:
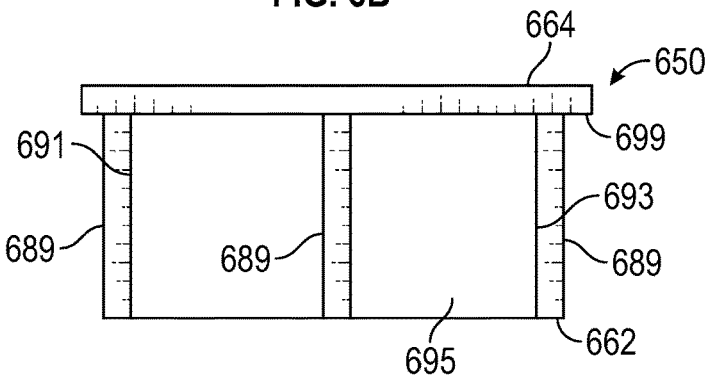
Figure 6D:
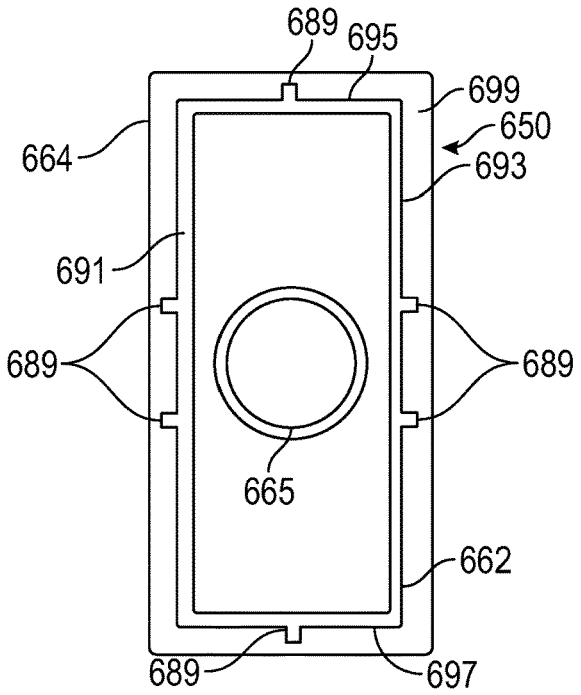
Figure 7A:
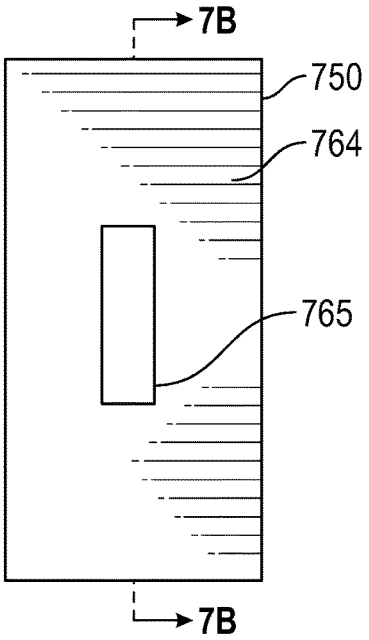
FIGS. 7A-7D provide a cross-section side view, and top, end, and bottom plan views of a divider comprising a top surface having a rectangular opening in accordance with a representative embodiment of the present invention.
Figure 7B:
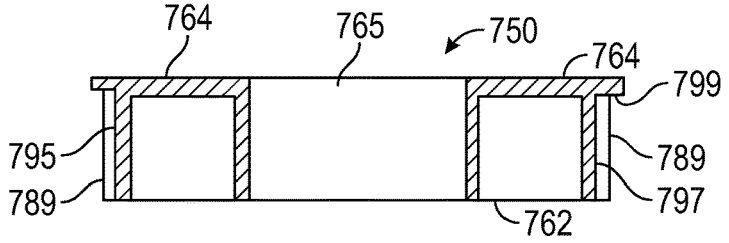
Figure 7C:
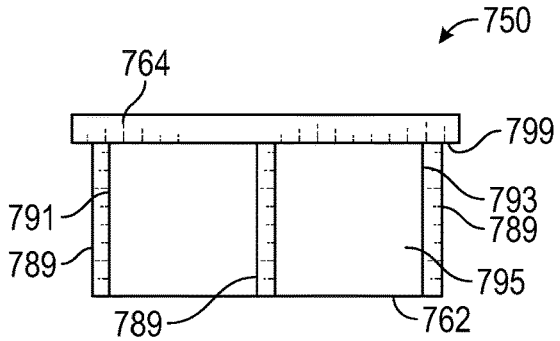
Figure 7D:
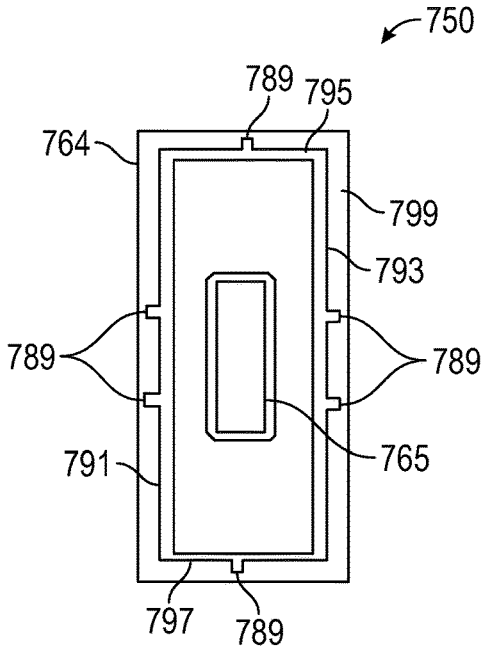

In some embodiments, a divider 551 is provided comprising an integrated handle or shaft 581 comprising a socket 585, such as a ¼-inch hex socket, as shown in FIGS. 5C and 5D. Socket 585 is configured to receive a plurality of bits 583, such as hex bits, comprising a variety of functional surfaces, such as screwdriver bits, torx bits, spanner bits, security bits, tamperproof bits, sockets, drill bits, and the like. In some embodiments, divider 551 (or another divider of the invention) is further modified to include a plurality of receptacles for storing a plurality of bits for use with socket 585. Thus, some embodiments of the present invention provide a divider having one or more features that may be used with one or more auxiliary tools.

Referring now generally to FIGS. 6A-11B, some embodiments of the present invention further comprise a divider having one or more storage compartments or surfaces configured to receive an auxiliary tool, material, part or object. With reference to FIGS. 6A-6D, a divider 650 is shown having first, second, third and fourth tool walls 691, 693, 695, 697 extending downwardly from a top surface 664. Top surface 664 further comprises an aperture or opening 665, such as a circular opening, forming a pathway through divider 650. In some embodiments, opening 665 comprises a shape, diameter, and height selected to accommodate storage of a desired auxiliary tool, such as a feather duster, a bottle brush, a handle portion of a tool, a bottle, or similarly shaped item. In some embodiments, opening 665 comprises a cylindrical shaft having top and bottom openings. In some embodiments, opening 665 comprises a cylindrical shaft having a closed or partially closed bottom surface (see, for example, FIGS. 8A, 8B, 11A and 11B). In some embodiments, opening comprises a cylindrical shaft having a tapered inner diameter.

Tool walls 691, 693, 695 and 697 further comprise one or more edges 689 configured to compatibly and selectively engage one or more receptacles 130 of a storage container. In some embodiments, edges 689 comprise a raised ridge or rail surface. In some embodiments, edges 689 comprise a channel or recessed groove or surface of one or more tool walls. In some embodiments, edges 689 comprise one or more surfaces that are keyed to selectively engage with a compatibly keyed surface or feature of a receptacle 130.

In some embodiments, divider 650 comprises a height that is less than a height of a sidewall 120 of a storage container into which divider 650 is inserted. In some instances, the lesser height of divider 650 results in the bottom-most surface of divider 650 resting directly on the inner surface of planar base 112, wherein the top surface 664 is position within interior volume 130 at a height that is lower than the upper perimeter edges of sidewalls 120 and/or rim 140. In some instances, top surface 664 overhangs at least one of tool walls 691, 693, 695, and 697 to provide a rim or lip 699. In some embodiments, top surface 664 overhangs all four tool walls to provide a lip that circumscribes the perimeter of top surface 664. In some embodiments, lip 699 is configured to contact and rest on the upper perimeter edges of sidewalls 120 and/or rim 140 when divider 650 is inserted therein, wherein the shortened height of divider 650 positions and/or suspends the bottom-most surface of divider 650 above the inner surface of planar base 112. In some instances, the suspended position of the bottom-most surface of divider 650 prevents an object stored within opening 665 from contacting the inner surface of planar base 112. In some embodiments, the shortened height of divider 650 permits two or more dividers to be stacked and occupy a same location or area within interior volume 130. In some embodiments, divider 750 comprises a square or rectangular opening, as shown in FIGS. 7A-7D, and further comprising various features and elements in common with one or more of the previously discussed dividers.

Figure 8A:
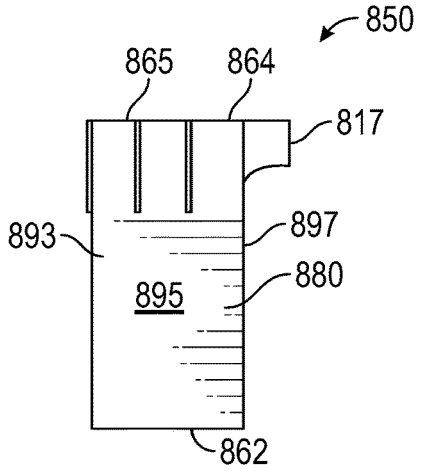
FIGS. 8A-8C provide side, front and top plan views of a divider comprising a container in accordance with a representative embodiment of the present invention.
Figure 8B:
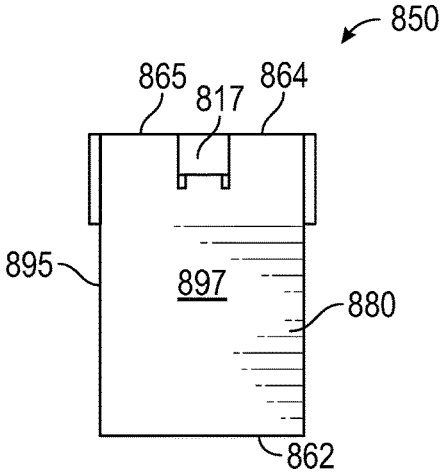
Figure 8C:
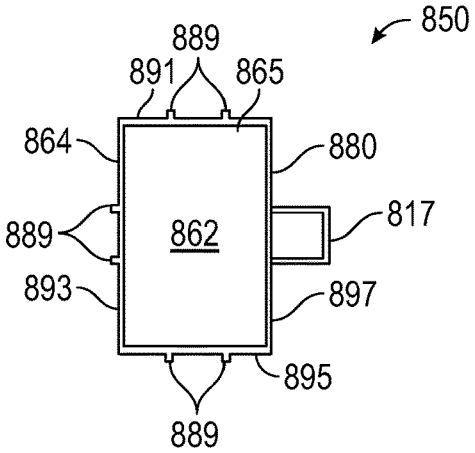

Referring now to FIGS. 8A and 8B, a divider 850 is shown having tool 880 comprising a storage compartment. In some embodiments, divider 850 comprises first, second, third, and fourth tool walls 891, 893, 895, and 897 which extend upwardly from a bottom surface 862. Divider 850 further comprises an opening 865 formed in the top surface 864 and defining a continuous perimeter of the tool walls, wherein divider 850 comprises a cup or similar type of container. In some embodiments, divider 850 further comprises a handle 817 coupled to an outer surface of a tool wall, for example fourth tool wall 897. In some instances, handle 817 is positioned near top surface 864 to provide easy user access when divider 850 is inserted within storage container 110. In some embodiments, divider 850 is configured to store a liquid, such as a cleaning solution or a rinsing solution. In some embodiments, opening 865 comprises a diameter sufficient to accommodate insertion of a user's hand. In some embodiments, opening 865 comprises a diameter sufficient to accommodate insertion of a mop head. In some embodiments, divider 850 further comprises a bucket handle coupled to two oppositely positioned tool walls, such as first and third tool walls 891 and 895.

Divider 850 further comprises a plurality of edges 889 configured to compatibly and selectively engage one or more receptacles 130 of storage container 110. In some embodiments, an outer surface of first, second, and third tool walls 891, 893, and 895 comprise edges 889 having a spacing configured to align with and compatibly engage respective receptacles 130 provided on the inner surfaces of sidewalls 120. In some embodiments, edges 889 are positioned near top surface 864 and extend along only a portion of the tool walls.

Figure 9:
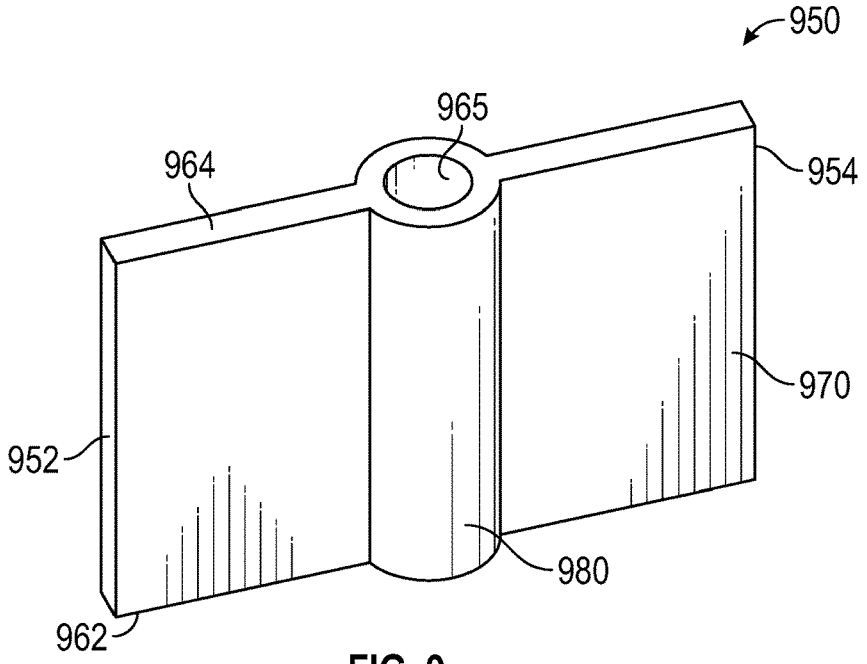
FIG. 9 provides a perspective top and front view of a divider comprising a single compartment in accordance with a representative embodiment of the present invention.
Figure 10:
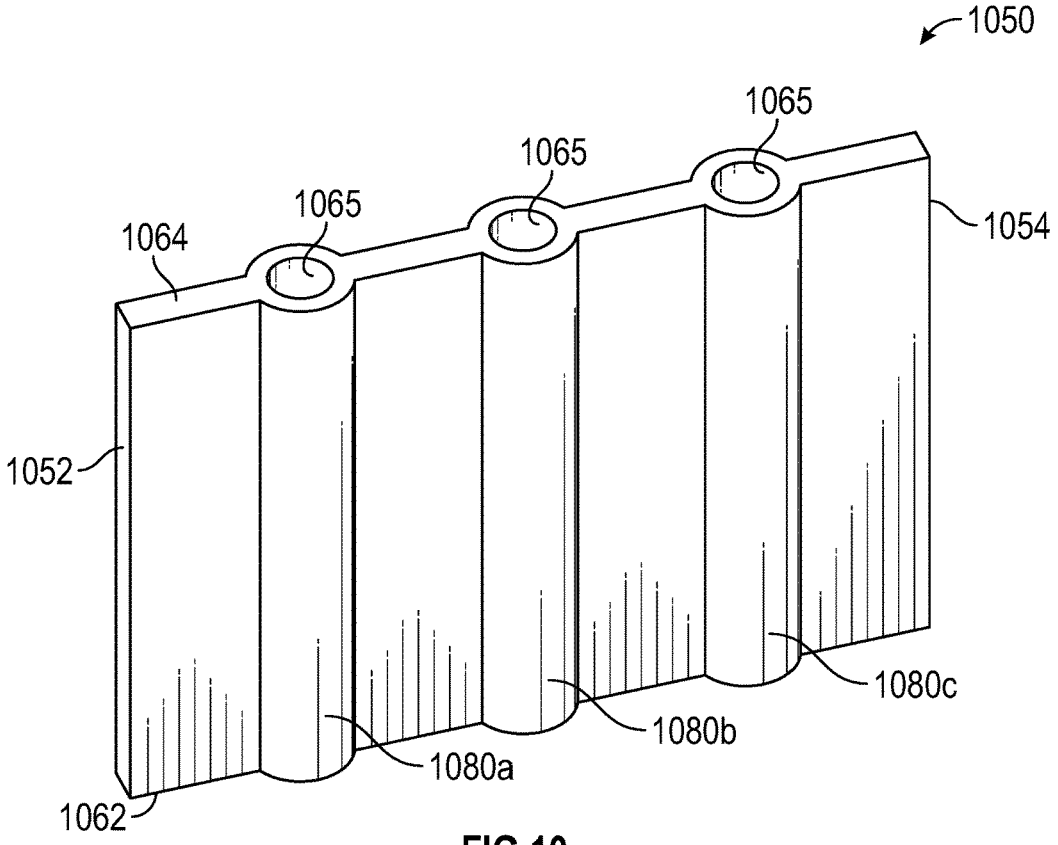
FIG. 10 provides a perspective top and front view of a divider comprising a plurality of compartments in accordance with a representative embodiment of the present invention.

Referring now to FIG. 9, a divider 950 is shown having a tool 980 comprising a storage compartment. Divider 950 comprises a first edge 952, a second edge 954, a bottom edge 962 and a top edge 964, wherein first, second, bottom, and top edges define a body portion 970 that is generally planar. Body portion 970 further comprises tool 980. In some embodiments, tool 980 comprises a hollow, cylindrical column having an upper opening 965. In some embodiments, tool 980 further comprises a solid or closed bottom end opposite upper opening 965. In some embodiments, tool 980 further comprises a lower opening opposite upper opening 965, such that tool 980 forms a vertical pathway through body 970. Tool 980 may comprise any diameter in accordance with the teaching of the present invention. Tool 980 may further comprise any geometric shape in accordance with the present invention. In some embodiments, a divider 1050 is provided comprising a plurality of tools 1080*a*, 1080*b*, and 1080*c*, each tool comprising a storage compartment, as shown in FIG. 10. In some embodiments, tools 980, 1080*a*, 1080*b*, and 1080*c* are configured to store a shaft structure of an object, such as a pencil, a pen, a handle, a screwdriver, a ruler, a scalpel or knife, a wrench handle, scissors, paint brush, cleaning brush, toothbrush, and the like. In some embodiments, divider 950 or 1050 further comprises additional storage compartments coupled to or extending outwardly from tools 980, 1080*a*, 1080*b* and/or 1080*c*, such that the additional storage compartments extend in a perpendicular orientation to body 970 and/or 1070.

Figure 11A:
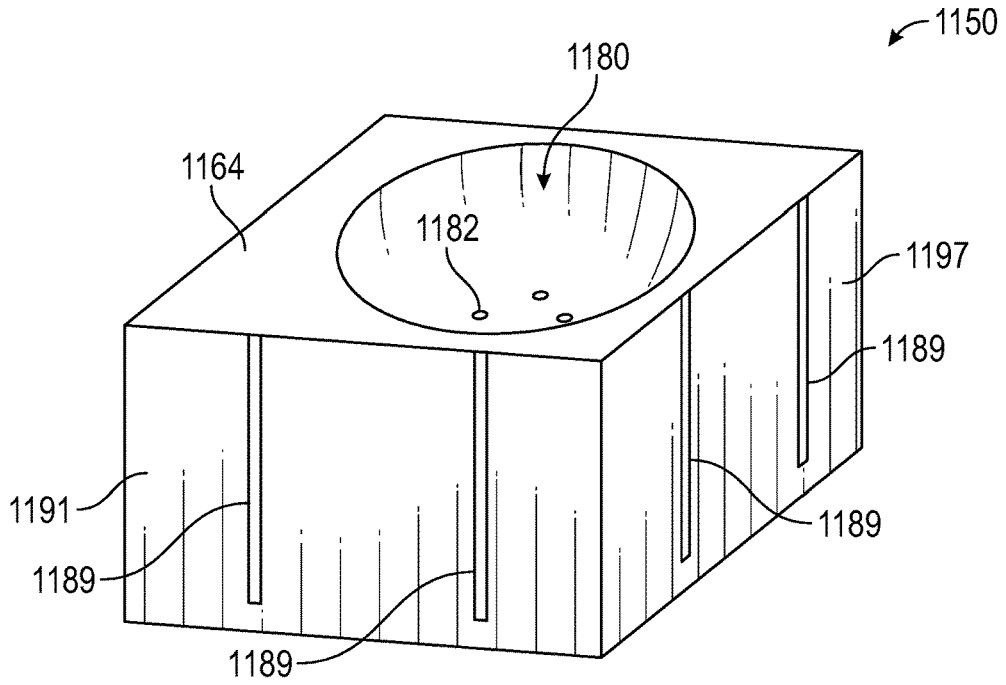
FIGS. 11A and 11B provide perspective and cross-section views of a divider comprising a top surface having a hemispherical concave compartment in accordance with a representative embodiment of the present invention.
Figure 11B:
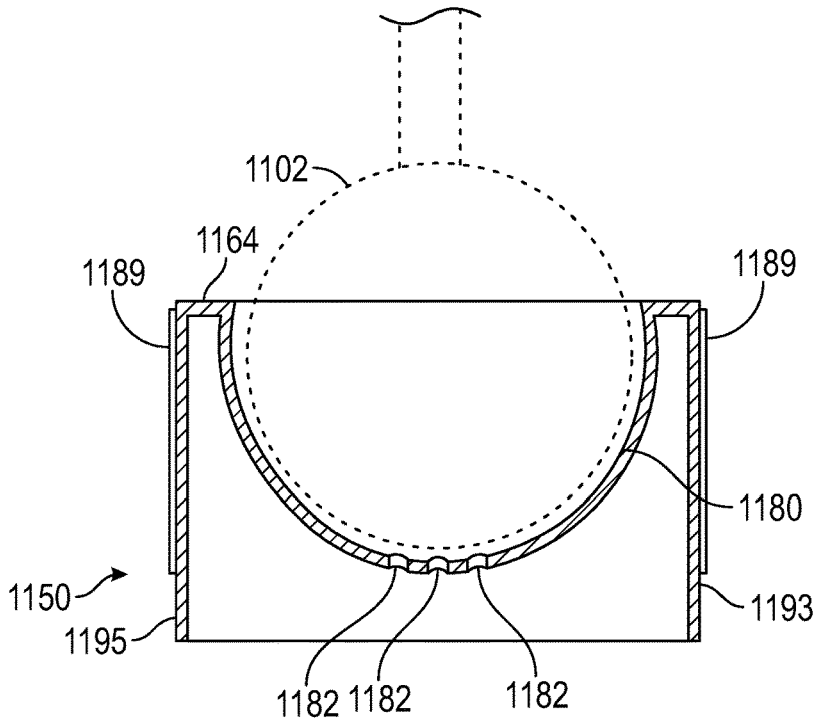

Referring now to FIGS. 11A and 11B, divider 1150 is shown having a tool 1180 comprising a storage compartment formed in a top surface 1164 and having a geometric shape configured to receive and store an auxiliary tool, material, part or object 1102. Divider 1150 comprises first, second, third, and fourth tool walls 1191, 1193, 1195 and 1197 extending downwardly from top surface 1164. An outer surface of one or more of the tool walls further comprises one or more edges 1189 configured to compatibly and selectively engage one or more receptacles 130, in accordance with previous embodiments. Top surface 1164 further comprises an opening 1165 providing access to an interior volume of tool 1180. Opening 1165 may comprise any shape, diameter, or other geometries as may be desired and in accordance with the teachings of the present invention. In some embodiments, opening 1165 comprises a circle. In some embodiments, the storage compartment of tool 1180 comprises a hemispherical concave recess configured to compatibly receive and store an object 1102 having a spherical or hemispherical shape, such as a toilet brush, a ball, a bowl, a cup, or similarly shaped object. In some embodiments, the concave recessed surface of tool 1180 provides a bowl or dish surface in which may be stored a plurality of small parts or objects. In some embodiments, a bottom-most portion of the concave recessed surface may comprise one or more drainage holes 1182 configured to prevent a liquid from gathering within tool 1180. In some embodiments, the dimensions of tool 1180 are selected to provide an interference or friction fit between the recessed concave surface an object 1102 stored therein.

Figure 12A:
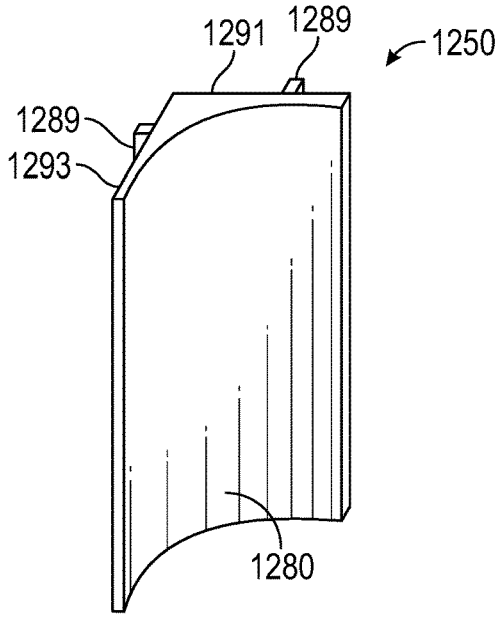
FIGS. 12A and 12B provide perspective and top plan views of a divider having tool walls for engaging receptacles of the storage container, and further comprising a tool or body surface comprising a concave geometry or shape in accordance with a representative embodiment of the present invention.
Figure 12B:
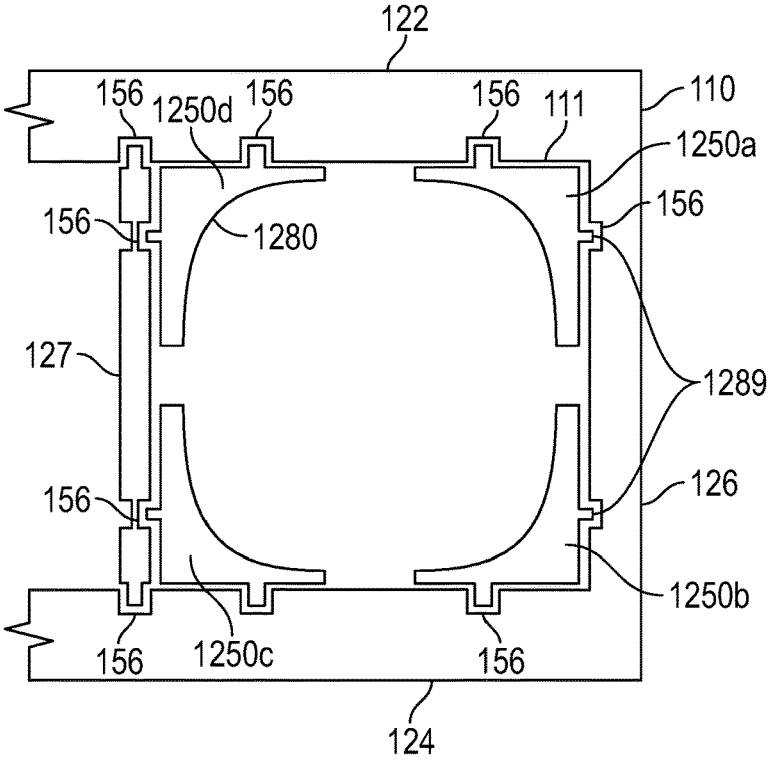

Referring now to FIGS. 12A and 12B, a divider 1250 is shown comprising a first tool wall 1291 positioned at 90 degrees from a second tool wall 1293, wherein first and second tool walls further comprise one or more edges 1289 configured to compatibly engage one or more receptacles 156 of storage container 110. Divider 1250 further comprises a tool 1280 comprising a geometric shape or surface, such as a concave surface, a convex surface, a chamfered surface, a tapered surface, a keyed surface, a textured surface, a gripping surface, and the like.

When selectively engaged with and inserted within storage container 110, the tool or tool surface 1280 of divider 1250 modifies an existing geometric shape or structure of storage container 110. For example, a squared corner 111 of storage container 110 comprises a right angle or square configuration where sidewalls 122 and 126 meet. When divider 1250*a* is inserted into storage container 110, corner 111 is modified by tool 1280 to be a concave radius. The further addition of dividers 1250*b*, 1250*c*, and 1250*d* modify the square corners of the square sub-compartment (defined by sidewalls 122, 124, 126, and divider 127) are rounded to provide a round sub-compartment. In some embodiments, dividers 1250*a*, 1250*b*, 1250*c*, and 1250*d* include a tool comprising a flat surface at approximately 45 degrees to first and second tool walls 1291 and 1293, wherein when the dividers are inserted into a square sub-compartment of storage container 110, the square sub-compartment is modified to provide an octagonal sub-compartment.

Figure 13A:
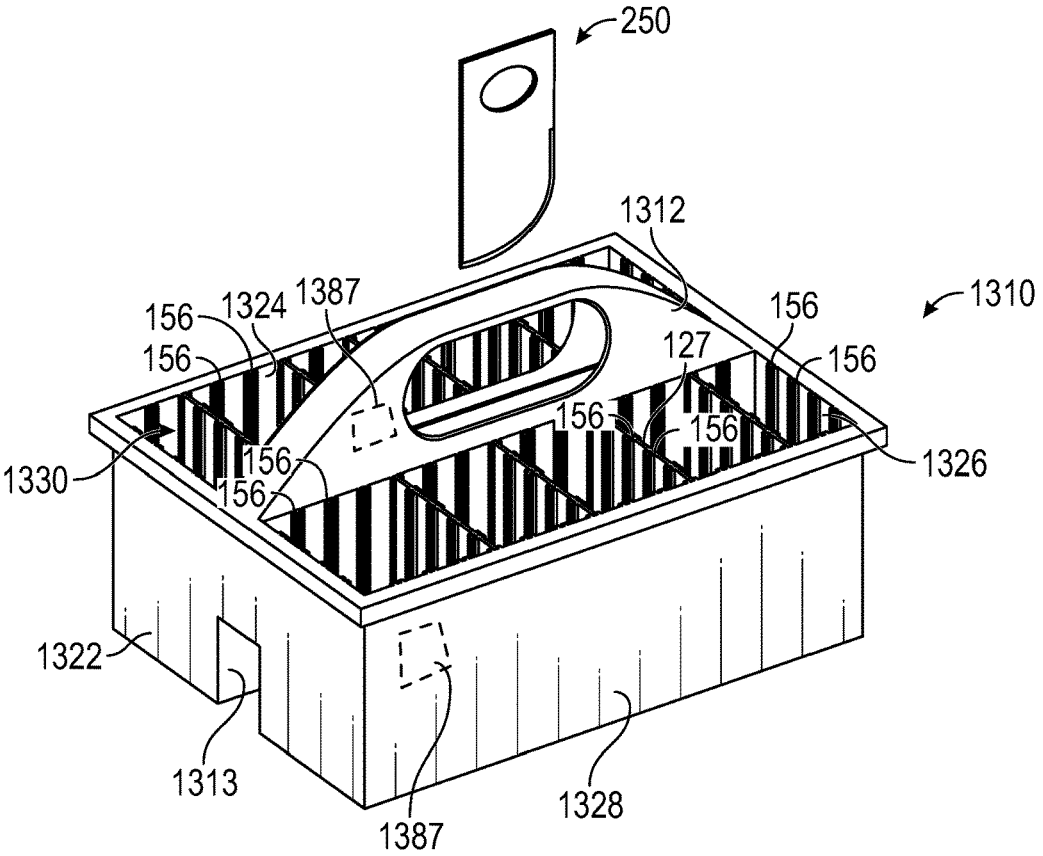
FIG. 13A provides an exploded perspective top and front view of a divider and a storage container having a plurality of sub-compartments in accordance with a representative embodiment of the present invention.
Figure 13B:
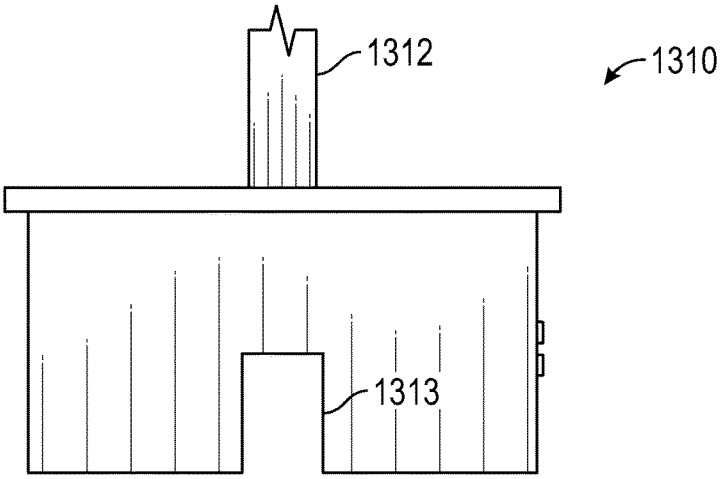
FIGS. 13B and 13C provide side and top plan views of the storage container of FIG. 13A.
Figure 13C:
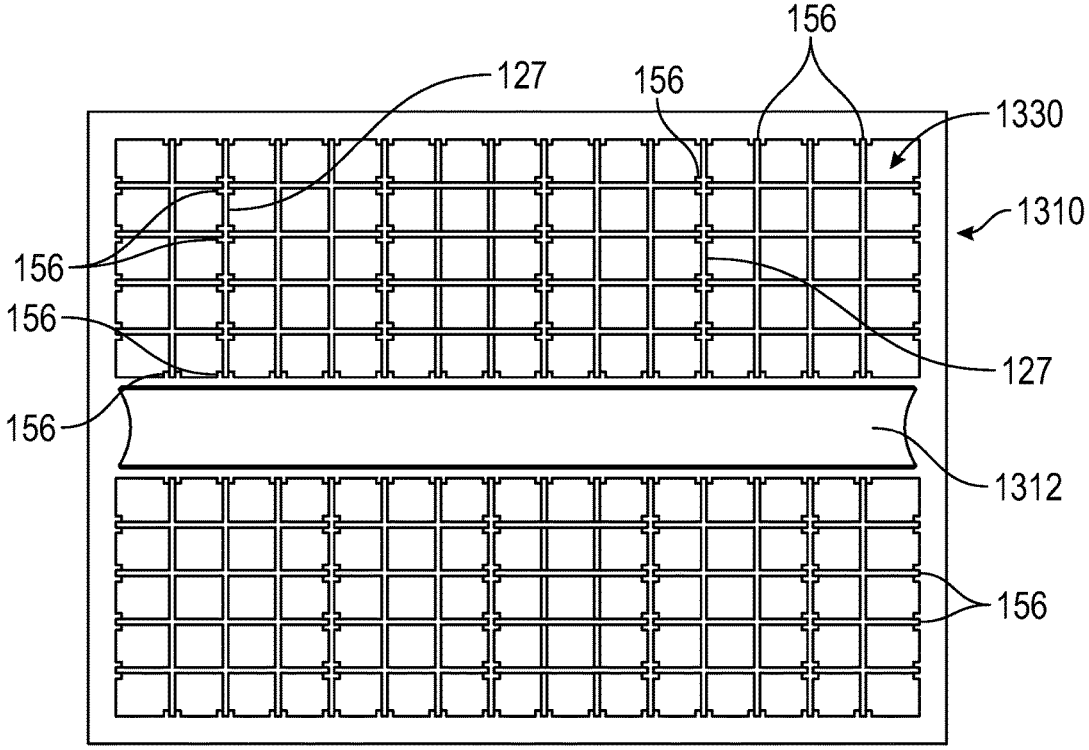

Referring now to FIGS. 13A-13C, a storage container 1310 of the present invention comprises a plurality of receptacles 156 having a desired spacing and placement for accommodating a variety of dividers 250. Receptacles 156 may further accommodate one or more standard partitions 127, which only provide a single function of dividing the interior volume 1330 into two or more sub-compartments. In some embodiments, partitions 127 further include one or more receptacles 156. In some embodiments, partitions 127 comprise receptacles 156 on both front and back surfaces of partition 127.

In some embodiments, storage container 1310 comprises a handle 1312. Handle 1312 may comprise any structure, shape, size, dimensions and other features compatible with the teachings of the present invention. In some embodiments, handle 1312 comprises a lower portion coupled to the inner sidewall and planar base surfaces and extending upwardly therefrom to provide an interior wall surface that divides the interior volume 1330 into two or more sub-compartments. In some embodiments, the lower portion of handle 1312 further comprises a plurality of receptacles 156. In some embodiments, handle 1312 is selectively coupled to storage container 1310.

In some embodiments, storage container 1310 further comprise a tool 1387 that is embedded within, or applied to, one or more surfaces of storage container 1310. For example, in some embodiments tool 1387 is integrated into or associated with handle 1312. In some embodiments, tool 1387 is integrated into or applied onto an interior or exterior sidewall, such as sidewall 1328. In some embodiments, tool 1387 comprises a magnet. In some embodiments, tool 1387 comprises an RFID chip, such as part of a security access card or identification badge. In some embodiments, tool 1387 comprises a mirror. In some embodiments, tool 1387 comprises an adhesive memo pad. In some embodiments, tool 1387 comprises a power source, such as a portable charger. In some embodiments, tool 1387 comprises a thumb drive. In some embodiments, tool 1387 comprises a hook and/or loop fastener material. In some embodiments, tool 1387 comprises one or more tools disclosed herein.

In some embodiments, storage container 1310 further comprises a recess or channel 1313 formed in the bottom surface and corresponding to a position of handle 1312. In some embodiments, channel 1313 is a hollow interior of handle 1312. In some embodiments, channel 1313 is configured to compatibly receive a handle of a second storage container when stacked atop storage container 1310, wherein the bottom surface of storage container 1310 rests on a rim of the second storage container. In some embodiments, handle 1312 is tapered to permit insertion within a channel 1313 of a storage container stacked on top of storage container 1310.

Figure 14:
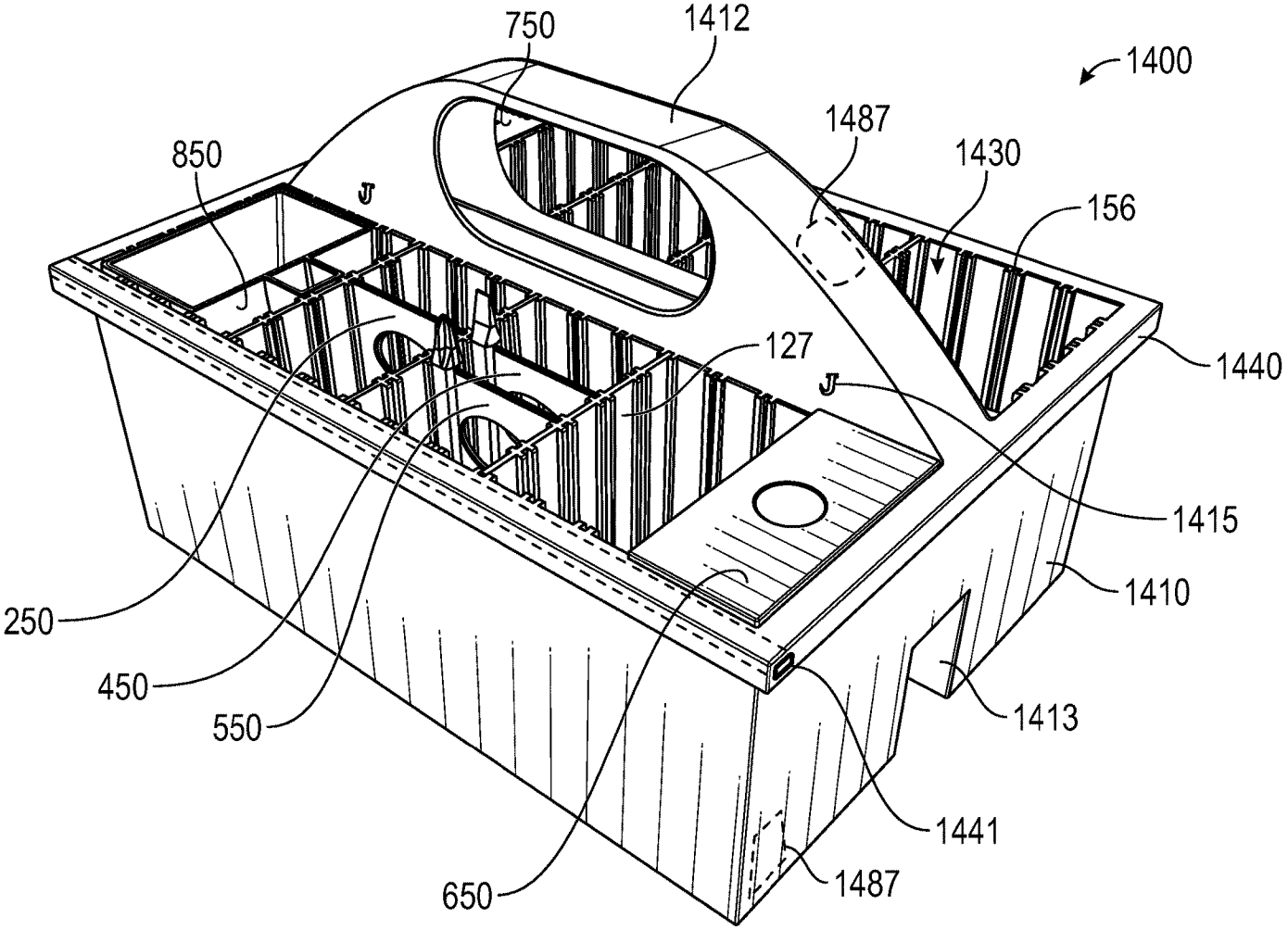
FIG. 14 provides a perspective top and front view of an assembled storage container system having a plurality of dividers comprising a variety of tools in accordance with a representative embodiment of the present invention.

Referring now to FIG. 14, a representative embodiment of an assembled storage system 1400 is shown. In some embodiments, a variety of sub-compartments is provided via a combined use of standard partitions 127 and one or more dividers having a first function for dividing a compartment into two or more sub-compartments, and having a second function unrelated to the first function (250, 450, 550, 650, 750 and 850). In some embodiments, a divider of the present invention further comprises one or more receptacles 156 by which a partition 127 or an additional divider may be inserted and retained within interior volume 1430.

In some embodiments, storage container 1410 further comprises a storage compartment 1441 located within a portion of rim 1440. In some embodiments, storage compartment 1441 comprises an elongated opening forming a pathway through a length or a portion of a length of rim 1440. Accordingly, in some embodiments storage compartment 1441 comprises a single opening and a closed end opposite the single opening. In some embodiments, storage compartment 1441 comprises first and second openings positioned on opposite ends or sides of storage container 1410. In some embodiments, storage compartment 1441 is configured to store an elongated item or object, such as a drain cleaning tool, welding rods, knitting needles, a writing utensil, a knife, or a similarly shaped object.

In some embodiments, a surface of storage container 1410 comprises one or more hooks 1415 or similarly shaped or functional elements to facilitate storage of a desired item. For example, in some embodiments handle 1412 comprises hooks 1415 that may be used individually or in concert to store an elongated item or object.

In some embodiments, a surface of storage container 1410 further comprises or more tools 1487 embedded therein or applied thereon. For example, in some embodiments storage container 1410 comprises a tool 1487 embedded within or applied onto a sidewall, a rim, or a handle 1412 portion of the container. In some embodiments, tool 1487 comprises one or more tools disclosed herein.

Figure 15:
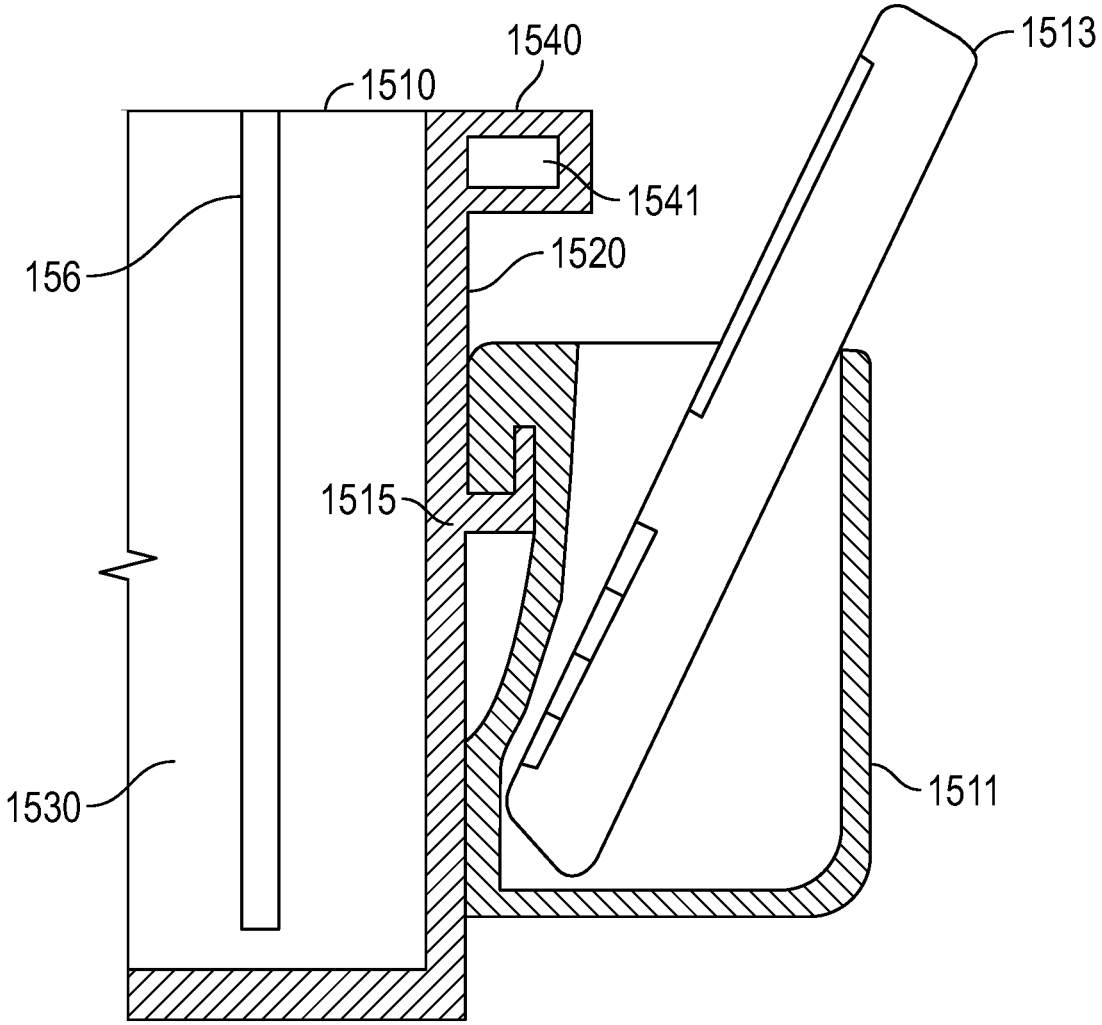
FIG. 15 provides a detailed cross-section side view of a storage container and external storage container in accordance with a representative embodiment of the present invention.

In some embodiments, an exterior or outer surface of a sidewall 1520 comprises an adapter 1515 configured to selectively receive a storage container 1511, as shown in FIG. 15. Adapter 1515 may comprise any surface, structure, configuration, size, shape or other feature as may be desired to selectively receive storage container 1511. Storage container 1511 further comprises a surface, structure, or other feature that is compatible for securement to adapter 1515.

In some embodiments, storage container 1511 comprises one or more compartments for storing an object outside of interior volume 1530. In some embodiments, storage container 1511 comprises a compartment for storing a cellular phone 1513. In some embodiments, storage container 1511 comprises an identification or badge holder. In some embodiments, storage container 1511 comprises a beverage holder. In some embodiments, storage container 1511 comprises a pouch, a hook or other structure for holding keys.

In some embodiments, adapter 1515 is suited for selectively receiving a variety of additional components or tools. For example, in some embodiments adapter 1515 is configured to compatibly receive a portable speaker. In some embodiments, adapter 1515 is configured to compatible receive a second storage container of the present invention. In some embodiments, adapter 1515 is configured to compatibly receive a handle. In some embodiments, adapter 1515 is configured to compatibly receive a cover for storage container 1510. In some embodiments, adapter 1515 is configured to compatibly receive a tool selected from the group consisting of a magnet, an RFID chip, an access or identification card, a mirror, an adhesive memo pad, a power source, such as a battery and/or a portable charger, a thumb drive, and a hook and/or loop fastener material.

The present invention further comprises one or more methods of manufacturing a storage system and/or the various components of a storage system disclosed herein, including one or more dividers and tools of the present invention. In some embodiments, a method for manufacturing a storage system includes steps for providing a storage container having a plurality of receptacles; and providing a divider having a first edge configured to selectively engage a first receptacle of the storage container, a second edge configured to selectively engage a second receptacle of the storage container, a bottom edge, a top edge positioned opposite the bottom edge, a body defining a surface between the first, second, bottom and top edges, and a tool comprising at least one of the top edge, the bottom edge, the first edge, the second edge, and the body, wherein the divider comprises a first function of dividing a compartment of the storage container into two or more sub-compartments, and further comprises a second function that is unrelated to the first function.

Some embodiments of the present invention further include a storage system comprising a kit, wherein the kit includes a storage container, and one or more dividers having a tool disclosed herein.

The present invention may be embodied in other specific forms without departing from its structures, methods, or other essential characteristics as broadly described herein and claimed hereinafter. The described embodiments and examples are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

All examples and conditional language recited herein are intended for pedagogical objects to aid the reader in understanding the invention and the concepts contributed by the inventor to furthering the art, and are to be construed as being without limitation to such specifically recited examples and conditions. Although implementations of the present inventions have been described in detail, it should be understood that the various changes, substitutions, and alterations could be made hereto without departing from the spirit and scope of the invention.

What is claimed is:

1. A divider configured to separate a compartment of a storage container said divider comprising:

a first vertical edge;

a second vertical edge positioned opposite the first vertical edge;

a bottom edge;

a top edge positioned opposite the bottom edge, said bottom and top edges being perpendicular to said first and second vertical edges;

a body defining a surface between the first vertical, second vertical, bottom, and top edges said body having a thickness; and a compartment formed in the body, said compartment having a first opening in the top edge, a second opening in the bottom edge, and an aperture extending through the body and between the first and second openings, such that the first opening is in fluid communication with the second opening via the aperture, said compartment further having an outer diameter and an inner diameter, said inner diameter being less than the outer diameter, and the thickness of the body being less than the outer diameter.

2. The divider of claim 1, where the thickness is less than the inner diameter.

3. The divider of claim 1, wherein said compartment comprises a plurality of compartments.

4. The divider of claim 3, further comprising a portion of the body interposed between adjacent compartments.

5. The divider of claim 3, further comprising:

a first inner diameter of a first aperture of a first compartment; and a second inner diameter of a second aperture.

6. The divider of claim 5, wherein the first inner diameter and the second inner diameter are equal.

7. The divider of claim 5, wherein the first inner diameter and the second inner diameter are unequal.

8. The divider of claim 3, further comprising:

a first outer diameter of the first compartment; and a second outer diameter of the second compartment.

9. The divider of claim 8, wherein the first outer diameter and the second outer diameter are equal.

10. The divider of claim 8, wherein the first outer diameter and the second outer diameter are unequal.

11. The divider of claim 1, wherein the inner diameter is constant over an entire height of the aperture.

12. The divider of claim 1, wherein the inner diameter is inconsistent over a height of the aperture.

13. The divider of claim 1, wherein the outer diameter is constant over an entire height of the compartment.

14. The divider of claim 1, wherein the outer diameter is inconsistent over a height of the aperture.

* * * * *